United States Patent [19]

Lonardi et al.

[11] Patent Number: 4,812,100

[45] Date of Patent: Mar. 14, 1989

[54] ROLLING TRACK FOR A ROTARY HOPPER

[75] Inventors: Emile Lonardi, L-Bascharage; Pierre Mailliet, L-Howard, both of Luxembourg

[73] Assignee: Paul Wurth S.A., Luxembourg

[21] Appl. No.: 168,901

[22] Filed: Mar. 16, 1988

[30] Foreign Application Priority Data

Mar. 24, 1987 [LU] Luxembourg ..... 86824

[51] Int. Cl.[4] ..... F23K 3/06

[52] U.S. Cl. ..... 414/199; 110/108; 110/293; 432/97; 222/168; 104/307; 209/910

[58] Field of Search ..... 414/149–150, 414/154–155, 163, 167, 172, 188, 199, 586–588; 110/108, 116, 118, 267, 293, 327; 432/97; 222/167, 168; 220/8, 66, 85 SP; 104/35, 46, 307; 105/239, 463.1; 209/244, 910, 919; 384/549, 620

[56] References Cited

U.S. PATENT DOCUMENTS 4,029,220 6/1977 Greaves ..... 414/588 X
4,728,203 3/1988 Okamoto et al. ..... 384/549

FOREIGN PATENT DOCUMENTS 289676 4/1967 Australia ..... 105/239

*Primary Examiner*—Robert J. Spar
*Assistant Examiner*—William M. Hienz
*Attorney, Agent, or Firm*—Fishman, Dionne & Cantor

[57] ABSTRACT

The rolling track comprises a series of rollers which are supported by a fixed reinforcement and on which travels the circular pedestal of the hopper. This circular pedestal is equipped with a toothed ring in order to be driven in rotary movement about its vertical axis. The rollers are grouped in pairs, and each pair of rollers is carried by an axle pivotable about a radial axis; with each of the rollers being carried in its axle by floating bearings mounted on springs.

10 Claims, 5 Drawing Sheets

ROLLING TRACK FOR A ROTARY HOPPER

BACKGROUND OF THE INVENTION

This invention relates to a rolling track for a rotary hopper of a loading installation for a shaft furnace. More particularly, this invention relates to a new and improved rolling track for a rotary hopper comprised of a series of rollers which are supported by a fixed reinforcement and on which travels the circular pedestal of the hopper. In addition, this pedestal is equipped with a toothed ring in order to be driven in a rotary movement about the vertical axis of the pedestal.

While not being limited thereto in its utility, the present invention is well suited for use as a stand-by hopper for a central loading installation of a shaft furnace, particularly a blast furnace. It is well known that granular charging or loading material for use in a shaft furnace will undesirably segregate according to their granulometry when disposed in a stand-by hopper. To minimize the impact of this segregation phenomenon, a recent proposal has been to rotate the hopper during its loading and, if appropriate, also during its emptying. The simplest solution involves mounting, on the circular reinforcement (e.g. pedestal) supporting the hopper, a series of track rollers, on which the hopper can rotate under the action of a drive pinion meshing with a toothed ring of the hopper pedestal. To avoid the need to make these supporting track rollers oversized because of the weight of the hopper (several hundred tons under full load), at least a minimum number of rollers, for example eight rollers, must be provided. Initially, it would seem logical to uniformly distribute these rollers over the entire periphery of the circular supporting reinforcement.

However, it has been found that, in this case, the hopper is not uniformly supported by all the rollers. In fact, often the hopper is supported by only three of the rollers. This non-uniform support can be caused by an asymmetry of the weight of the batch, wear or deformation of some of the rollers, deposits of dirt on the rolling surface of the hopper, incorrect vertical adjustment of the rollers, etc. Not only does this non-uniform support result in a lack of stability of the hopper, but also all the rollers have to be designed so that three of them are capable of supporting the entire load so as to avoid the risk of premature wear. Besides the additional costs incurred as a result of such oversizing (the rollers are necessarily relatively large and wide), this oversizing contradicts the experience gained in this field where it has been found that the supporting track rollers must be as thin as possible to ensure rolling without friction and to prevent the wheels from bearing on one point only (for example, because of a slight deformation of the supporting framework).

SUMMARY OF THE INVENTION

The above-discussed and other drawbacks and deficiencies of the prior art overcome or alleviated by the novel rolling track of the present invention wherein all of the rollers participate equally and uniformly in the support of the hopper. In a preferred embodiment of the present invention, the rollers in the rolling track are grouped in pairs. Each pair of rollers is carried by an axle pivotable about a radial axis with each of the rollers being mounted in the axle by floating bearings mounted on springs.

In a preferred embodiment of the present invention, the track comprises eight rollers, that is, four pairs of rollers carried by four axles located at the cardinal points of the circular track or pedestal.

Since the two rollers carried by the same axle can pivot about a horizontal axis, they automatically position themselves in order to support substantially the same weight. However, under this scenario, it is possible for the hopper to be balanced on two diametrically opposed pairs of rollers. To prevent this possibility, all of the rollers have been mounted, within their axles, on floating bearings mounted on springs. The dimensions of these springs are such that, when eight rollers are used, each of them can withstand, without being compressed, one eighth of the maximum load to be supported. Once this load has been exceeded, the springs are compressed. In other words, in the hypothetical situation where the hopper is balanced on only four rollers, the springs supporting these rollers do not withstand the load and are compressed, thus allowing the hopper to slightly subside so as to be uniformly supported by all the rollers. It is therefore sufficient for all the rollers to have dimensions appropriate for supporting only one-eighth of the maximum load, plus a certain safety percentage.

In accordance with the present invention, each axle is preferably carried by a pivot mounted radially on the inner face of a supporting block fastened to the circular supporting reinforcement. Each axle comprises two boxes welded on either side of a central sleeve which is removably engaged on its supporting pivot.

In accordance with another feature of the present invention, each box is provided with rectangular orifices arranged on the upper and lower faces thereof for the passage of the rollers; and with two opposite rectangular orifices on the outer and inner faces in each of which a bearing is engaged. Each of the bearings are equipped, on opposite sides, with vertical grooves engaged in the vertical edges of the rectangular orifices to ensure retention and the possibility of vertical sliding. In addition, each of the bearings rests freely on two helical springs supported by the bottom of the box.

Each roller is preferably mounted by means of a rolling bearing on a shaft carried on each side by the floating bearings. The hopper is retained horizontally by means of horizontal rollers mounted on each of the supporting blocks.

In accordance with still another feature of the present invention, each supporting block possesses a radially oriented rocker lever, the inner end of which has a head located above the circular pedestal of the hopper. The outer opposite end of the rocker lever is subjected to a powerful spring keeping the head at a slight distance above the pedestal (without touching it) under normal operating conditions. Under abnormal conditions (for example in the event of earth tremors in countries at risk), these levers keep the hopper in place.

The above discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
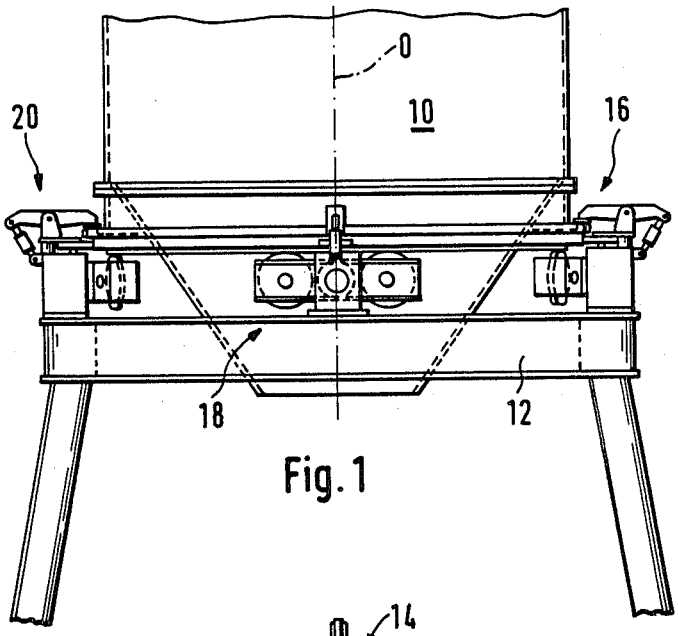
FIG. 1 is a diagrammatic side elevation view of a hopper supported by a rolling track in accordance with the present invention.

Referring to FIG. 1, a stand-by hopper is identified at 10 for a loading installation of a shaft furnace. Hopper 10 rotates about its vertical axis 0. Hopper 10 is carried by a circular reinforcement 12 via a rolling track (see also FIG. 2) consisting of four rolling groups 14, 16, 18 and 20. These rolling groups, each comprising a pair of rollers, are located at the four cardinal points of the circular reinforcement 12.

Figure 2:
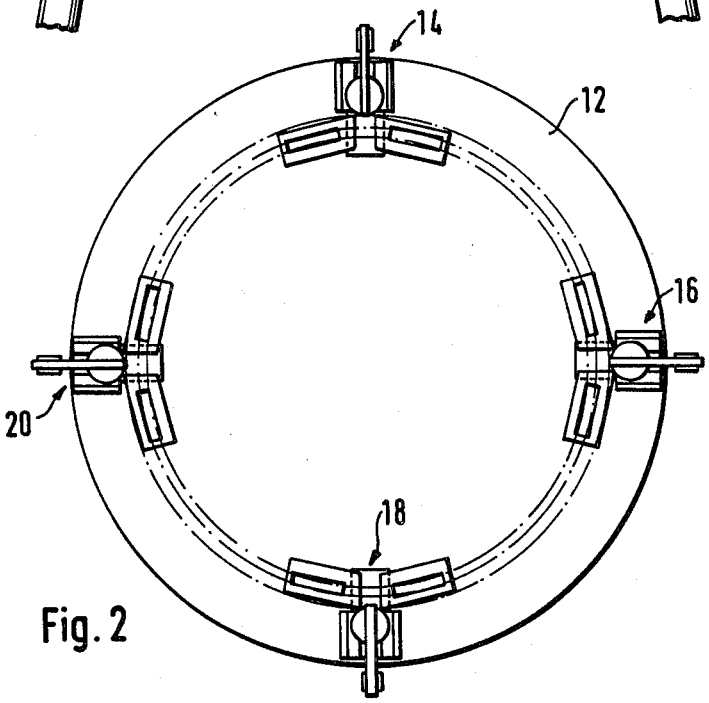
FIG. 2 is a plan view of the rolling track.
Figure 3:
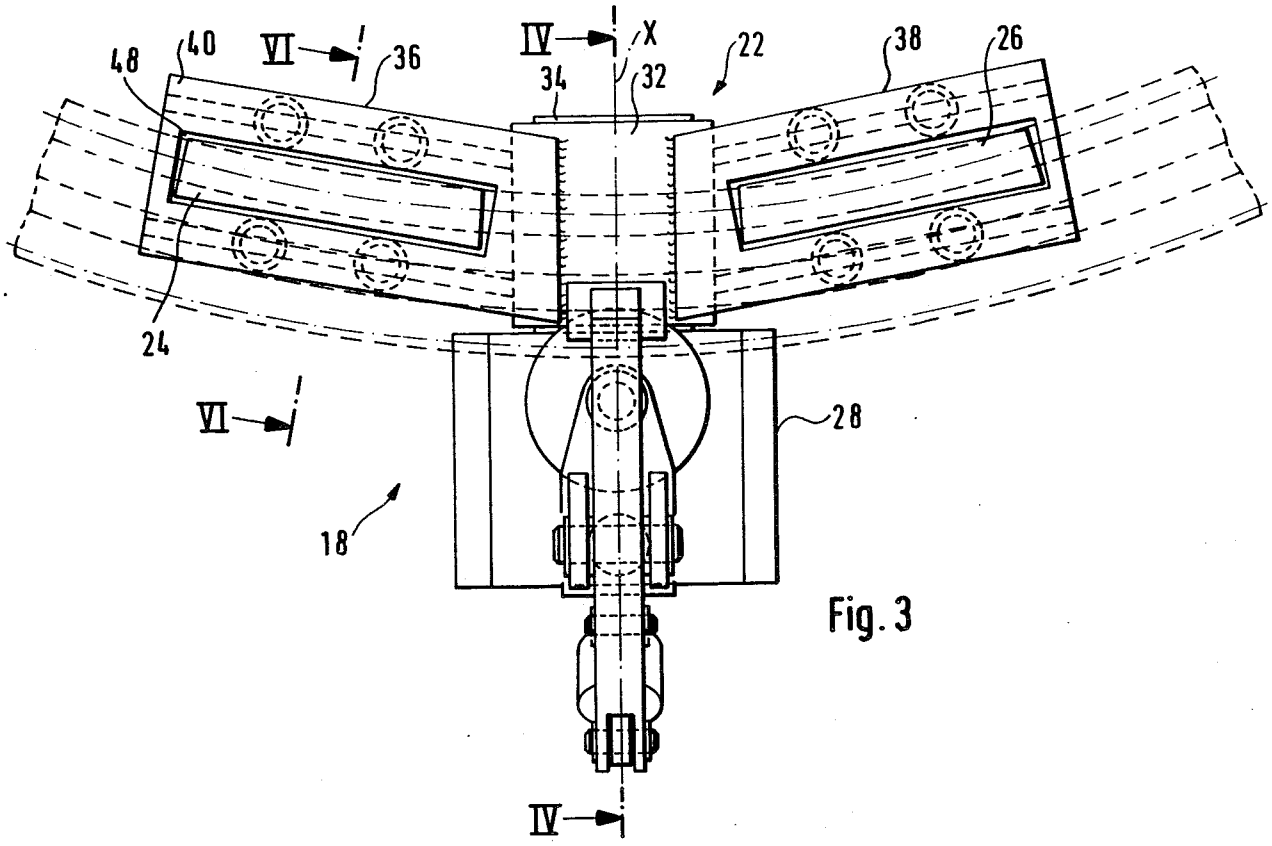
FIG. 3 is an enlarged plan view of a pair of rollers in their supporting axle.

FIG. 3 is an enlarged view of one of the rolling groups as shown in FIG. 2 (in this particular case the rolling group 18). Since the other rolling groups 14, 16 and 20 are identical to the group 18, it will be sufficient hereinafter to limit the description to FIG. 3. As shown in FIG. 3, rolling group 18 essentially comprises an axle 22 supporting a pair of rollers 24, 26. Axle 22 is mounted on a supporting block 28 which is welded or bolted to reinforcement 12. One of the particular features of the mounting of axle 22 is that it can pivot about a horizontal axis X which extends radially relative to the hopper, that is, it intersects the vertical axis of rotation of the hopper.

Figure 4:
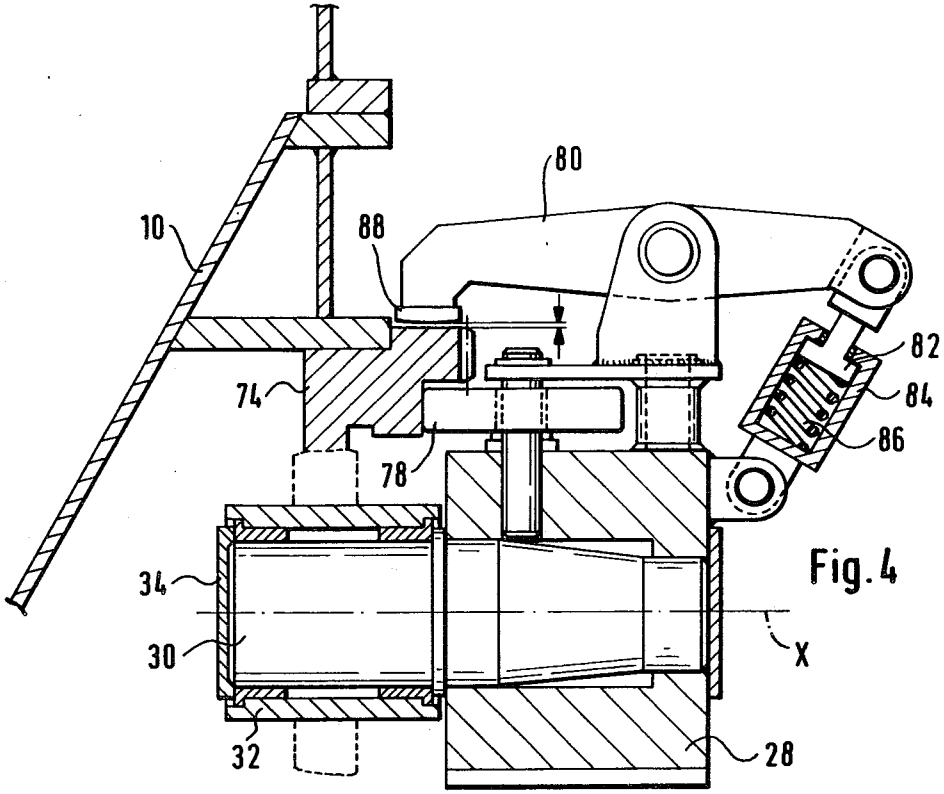
FIG. 4 is an elevation view partly in vertical cross section, along the line IV—IV of FIG. 3.

FIG. 4, which shows a vertical section through supporting block 28 passing through axis X, illustrates the details of the mounting of axle 22. A cylindrical pivot 30, the axis of which defines the pivot axis x, is fixed to the supporting block 28. Axle 22 includes a central sleeve 32 of a size which allows it to be slipped onto pivot 30 and to be pivotable about the pivot. Sleeve 32 is held in position by means of a front plate 34 threadably fastened to pivot 30.

Axle 22 also includes two boxes 36 and 38 welded to central sleeve 32 symmetrically on either side. The two boxes 36 and 38 form the receptacles for two rollers 24, 26 and will be described in more detail with reference to FIGS. 5 and 6. However, because the receptacles of the two rollers 24 and 26 are identical to one another, only the receptacle of roller 24 will be described in more detail below.

Figure 6:
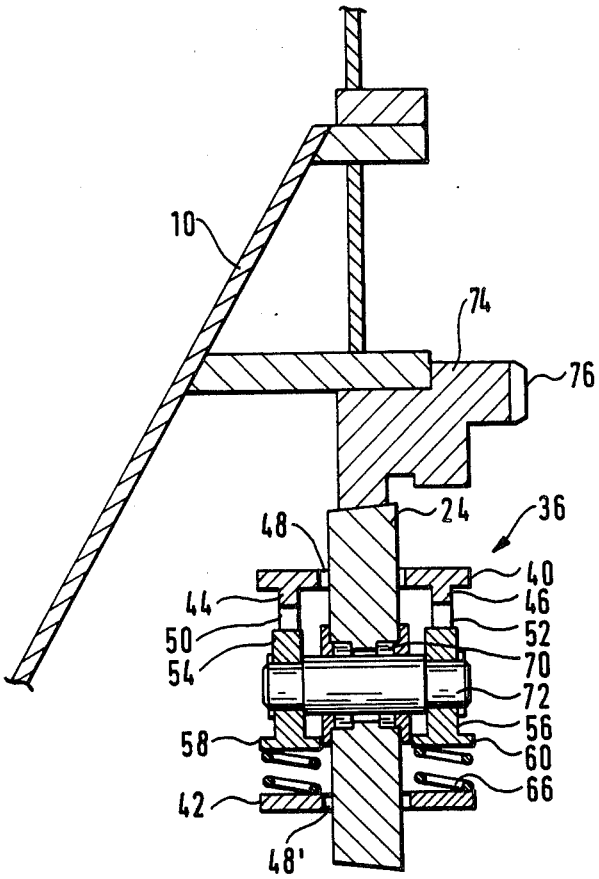
FIG. 6 is a cross sectional elevation view through a roller along the line VI—VI of FIG. 3.

As shown in FIG. 6, box 36 (in which roller 24 is accommodated) has a substantially rectangular cross section consisting of an upper wall 40, a lower wall 42, an inner side wall 44 and an outer side wall 46, all of these walls being welded to one another. The upper and lower walls 40, 42 have elongated rectangular orifices 48, 48' of a width slightly greater than the thickness of roller 24 to allow the latter to pass therethrough.

Figure 5:
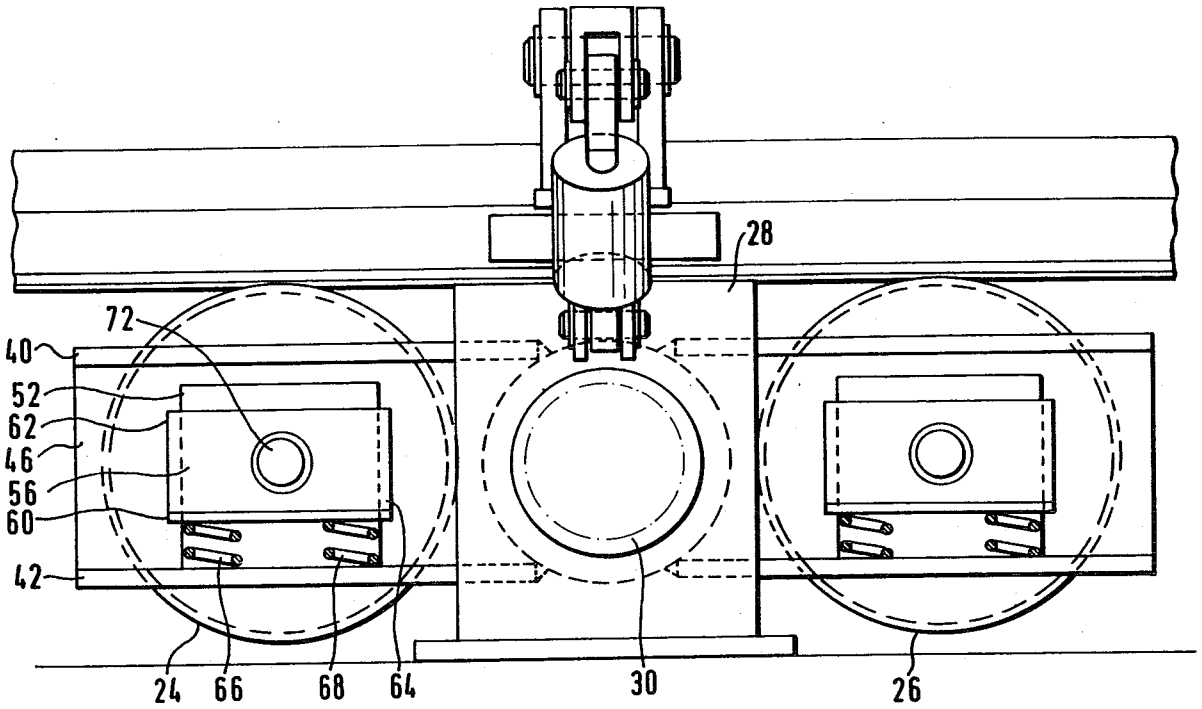
FIG. 5 is an elevation view showing the outside of a pair of rollers and their supports in a radial direction along the axis of the hopper.

Substantially rectangular orifices 50, 52 are made in side walls 44 and 46 (see also FIG. 5). Orifices 50, 52 similarly include rectangular plates 54, 56 which form the supporting bearings of roller 24. Plates 54, 56 have, along the lower edge, a wider part forming feet 58, 60. The width of plates 54, 56 is slightly greater than orifice 52. However, on the lateral sides thereof, plates 54, 56 have vertical grooves 62, 64, the cross section of which are U-shaped and in which are engaged the vertical lateral edges of each of orifices 50, 52. Plates 54 and 56, while being held by side walls 44, 46 of box 36, can slide vertically relative to the sidewalls by means of the lateral grooves 62, 64. As shown in FIGS. 5 and 6, each of the plates 54, 56 rests by means of its feet 58, 60 on a pair of helical compression springs 66, 68 carried by lower wall 42 of box 36.

As can be seen from FIG. 6, roller 24 is carried on a shaft 72 by means of a rolling bearing 70. In turn, shaft 72 is carried on either side of roller 24 by plates 54 and 56.

Each of rollers 24 is thus mounted in a floating manner, and its position will be the resultant of both the force exerted by the weight of the hopper and the force exerted by the four springs supporting these bearings.

FIG. 6 also shows the lower part of the side wall of hopper 10. This lower sidewall section is equipped with a circular pedestal 74 which is carried by the track rollers and which is equipped with a peripheral toothed ring 76 so as to be actuated by means of a drive pinion.

As shown in FIG. 6, all of the rollers have a frustonconical cross section, the potential vertex of which is on the axis of rotation 0 of the hopper. The runway of pedestal 74 is inclined so as to correspond to the conicity of the rollers. This conicity has been provided in order to prevent friction in the region of contact between the rollers and the rolling surface of pedestal 74.

A horizontal roller 78 is also arranged on each supporting block 28. This roller 78 similarly travels on pedestal 74 during the rotation of the hopper and ensures that the hopper is laterally retained.

On each of supports 28 is a rocker lever 80 pivotably mounted on a bracket of support 28 and oriented radially relative to hopper 10. The outer end of lever 80 is articulated on block 28 by means of a cylinder 84. Inside cylinder 84 is a relatively powerful helical spring acting on a piston 82, by means of which the cylinder is connected to lever 80. The opposite end of lever 80 has a head 88 held at a slight distance from pedestal 74 under the action of spring 86, so that, during normal operation, head 88 remains out of contact with pedestal 74 during the rotation of the hopper. It will be appreciated that this device constitutes a safety facility for furnaces installed in regions where there is a risk of earth tremors and also prevents the hopper from being upset accidentally (for example, as a result of a shock received from a crane). In fact, lever 80 prevents hopper 10 from wobbling under the effect of violent jolts by means of the action of spring 86 which damps possible vibrations of pedestal 74; and which prevents it from rising by an amount greater than that of the stroke of piston 82 in cylinder 84.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Circular rolling track for a rotary hopper for a loading installation of a shaft furnace, the rotary hopper including a circular pedestal, comprising:

a plurality of rollers supported by a fixed reinforcement, the circular pedestal of the hopper traveling on said rollers, said pedestal including a toothed ring for rotary movement about its vertical axis;

said rollers being grouped in pairs wherein each pair of rollers is carried by a support axle pivotable about a radial axis, said support axle being supported by said fixed reinforcement; and each of said pairs of rollers being mounted on their respective support axles by floating bearing means mounted on first spring means.

2. Track according to claim 1 further comprising:

eight of said rollers carried by four of said axles located at the four cardinal points of the circular track.

3. Track according to claim 1 wherein said circular pedestal is mounted above a circular reinforcement and wherein:

each of said support axles is carried by a supporting pivot mounted radially on the inner face of a supporting block fastened to said circular reinforcement.

4. Track according to claim 3 wherein:

each of said support axles comprises two boxes attached to either side of a central sleeve which is removably engaged on said supporting pivot.

5. Track according to claim 4 wherein:

each box includes first and second oppositely disposed rectangular orifices on its upper and lower faces for the passage of said rollers, and two oppositely disposed third and fourth rectangular orifices on its outer and inner faces;

said floating bearing means being engaged in said third and fourth orifices, said floating bearing means being equipped, on opposite sides, with vertical grooves engaged on vertical edges of said third and fourth rectangular orifices to ensure retention and vertical sliding; and said floating bearing means resting freely on said first spring means supported by the bottom of each of said boxes.

6. Track according to claim 5 wherein:

each roller is mounted by roller bearing means on a shaft carried on each side by said floating bearing means.

7. Track according to claim 3 including:

horizontal roller means for retaining the hopper laterally, said horizontal roller means being mounted on each of said supporting blocks.

8. Track according to claim 1 including:

a radially oriented rocker lever mounted on each of said supporting blocks, said rocker lever having opposed first and second ends, said first end of said rocker lever having a head located above the circular pedestal of the hopper and said second end of said rocker lever communicating with second spring means for maintaining said head at a slight distance above said pedestal.

9. Track according to claim 1 wherein:

all of said rollers have a frustonconical cross section, the potential vertex of which is located on the axis of rotation of the hopper; and the runway of said pedestal has an inclination corresponding to the conicity of said rollers.

10. Track according to claim 5 wherein:

said first spring means comprises two helical springs.

* * * * *